US005121609A

United States Patent [19]

Cieslukowski

[11] Patent Number: 5,121,609

[45] Date of Patent: Jun. 16, 1992

[54] NO LOSS FUELING STATION FOR LIQUID NATURAL GAS VEHICLES

[75] Inventor: Robert E. Cieslukowski, Bloomington, Minn.

[73] Assignee: Minnesota Valley Engineering, New Prague, Minn.

[21] Appl. No.: 702,075

[22] Filed: May 17, 1991

[51] Int. Cl.[5] ..... F17C 9/04

[52] U.S. Cl. ..... 62/50.4; 123/525; 123/527

[58] Field of Search ..... 62/50.4; 123/527, 525

[56] References Cited

U.S. PATENT DOCUMENTS

| | | | |
|---|---|---|---|
| 2,035,399 | 11/1934 | Murphy . | |
| 2,257,897 | 10/1941 | Zenner et al. . | |
| 2,384,677 | 9/1945 | Hill . | |
| 2,645,906 | 7/1953 | Ryan . | |
| 2,645,907 | 7/1953 | Droste et al. . | |
| 2,993,344 | 7/1961 | Reed . | |
| 3,183,678 | 5/1965 | Hosford | 62/50.4 |
| 3,898,853 | 8/1975 | Iung | 62/50.4 |
| 4,018,582 | 4/1977 | Hinds et al. | 62/50.4 |
| 4,080,800 | 3/1978 | Spaulding et al. | 62/50.4 |
| 4,406,129 | 9/1983 | Mills . | |
| 4,449,509 | 5/1984 | Young . | |
| 4,531,497 | 7/1985 | Smith . | |

FOREIGN PATENT DOCUMENTS

| | | |
|---|---|---|
| 3233935 | 3/1984 | Fed. Rep. of Germany . |
| 0251598 | 11/1987 | Japan . |

*Primary Examiner*—Ronald C. Capossela
*Attorney, Agent, or Firm*—Rockey & Rifkin

[57] ABSTRACT

The fueling station of the invention consists of a vacuum insulated storage vessel for delivering LNG to a pressure building tank. The pressure building tank holds a quantity of LNG and a natural gas head. The pressure in the pressure building tank is lowered using liquid nitrogen ($LN_2$) to condense the natural gas head and is raised by vaporizing the LNG. A valve system connects the supply of LNG in the pressure building tank to the vehicle being supplied to allow either LNG or natural gas to be delivered to the vehicle tank and allows natural gas in the vehicle tank to be vented back to the fueling station. The fueling station of the invention includes suitable controls for controlling the pressure of the LNG delivered to the vehicle, the pressure in the fueling station itself and the pressure in the vehicle.

25 Claims, 2 Drawing Sheets

FIG. 2
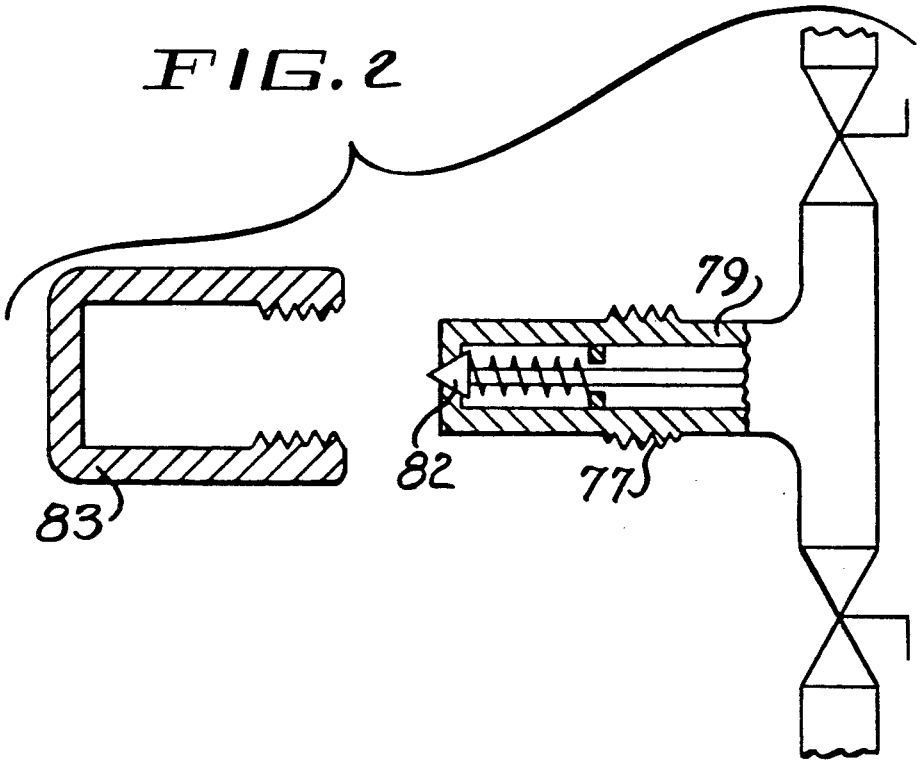
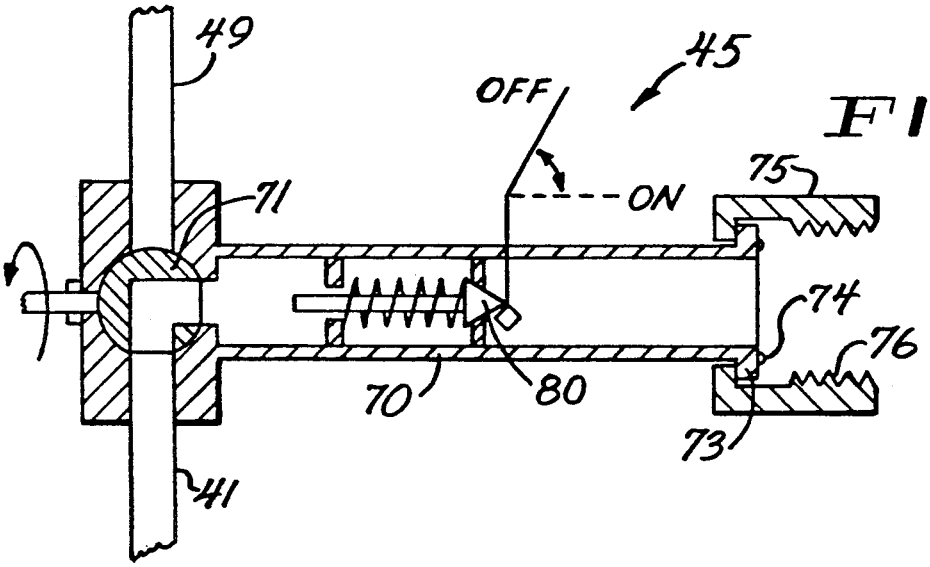
FIG. 3A
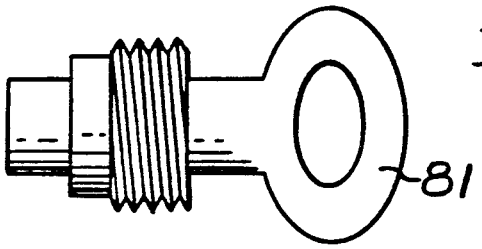
FIG. 3B

NO LOSS FUELING STATION FOR LIQUID NATURAL GAS VEHICLES

BACKGROUND OF THE INVENTION

This invention relates, generally, to liquid natural gas (LNG) delivery systems and, more specifically, to a no loss fueling station for LNG particularly suited for use with natural powered motor vehicles.

America's dependence on foreign sources of fuel oil has resulted in significant political and economic problems in recent years. As a result, great efforts have been made to find a cheaper and more reliable domestic energy alternative. One such alternative is natural gas which is domestically available, plentiful, relatively inexpensive and environmentally safe as compared to oil. Because one of the largest uses for oil is as a fuel for motor vehicles, great strides have been made to develop alternative fuels including natural gas.

One possibility is a dual-fuel modified diesel engine which runs on a 60/40 diesel fuel to LNG mixture. While this engine substantially reduces diesel fuel consumption, it requires that LNG be delivered to the engine at approximately 300 psi, a pressure approximately 6 times the normal storage pressure for LNG. Other natural gas powered engines require that the LNG be delivered at pressures ranging from less than 50 psi to more than 500 psi. Therefore, a LNG fueling station that can deliver LNG to vehicles having wide variations in delivery pressure requirements is desired.

Moreover, LNG is an extremely volatile substance that is greatly affected by changes in pressure and temperature. As a result, the fueling station must be able to accommodate fluctuations in pressure and temperature and transitions between the liquid and gas states. Optimally, the fueling station should be able to meet these conditions without venting LNG to the atmosphere because the venting of LNG is wasteful and potentially dangerous.

Thus a no loss LNG fueling station that is efficient, safe and can deliver LNG at a range of pressures is desired.

SUMMARY OF THE INVENTION

The fueling station of the invention consists of a vacuum insulated storage vessel for storing and delivering LNG to a pressure building tank. The pressure building tank holds a quantity of LNG with a natural gas head. The pressure in the pressure building tank is lowered by condensing the natural gas using a liquid nitrogen ($LN_2$) cooling system and is raised by vaporizing the LNG through a heat exchanger. A valve system connects the supply of LNG in the pressure building tank to the vehicle being supplied to allow either LNG or natural gas to be delivered to the vehicle tank and allows natural gas in the vehicle tank to be vented back to the fueling station. The fueling station of the invention includes suitable means for controlling the pressure of the LNG delivered to the vehicle, the pressure in the fueling station itself and the pressure in the vehicle's fuel tank.

BRIEF DESCRIPTION OF THE DRAWINGS

FIGS. 2 and 3 shows details of the two-way injection valve of FIG. 1.

DETAILED DESCRIPTION OF THE INVENTION

Figure 1:
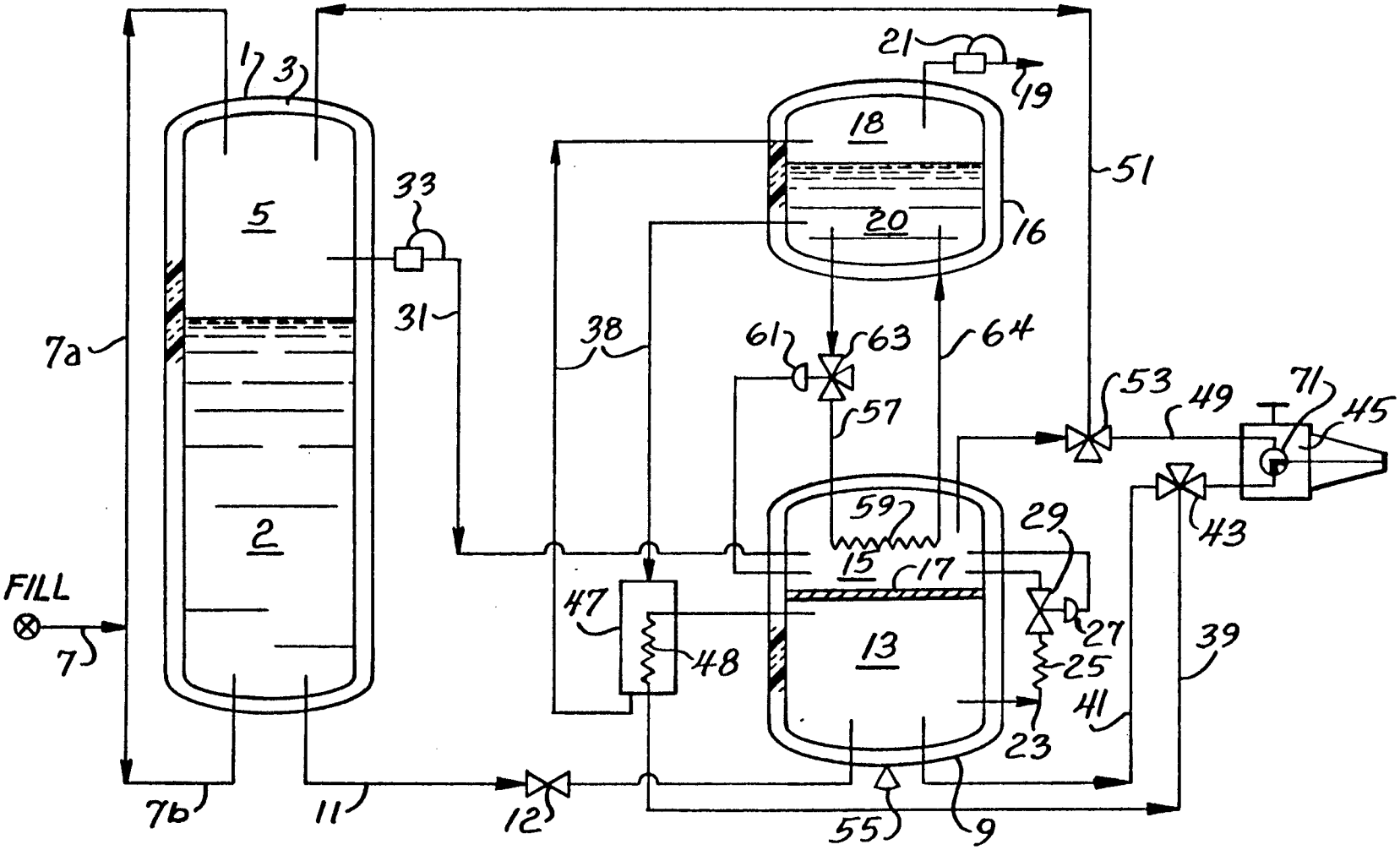
FIG. 1 shows a schematic view of the fueling station of the invention.

Referring more particularly to FIG. 1. the fueling station of the invention consists of a storage vessel 1 holding a supply of LNG 2. Storage vessel 1 is a double-walled tank having a vacuum insulated space 3 therein. Although vessel 1 is insulated, some heat transfer will occur between the LNG 2 and the ambient environment As a result, a natural gas head 5 is created which pressurizes the LNG in tank 3.

A fill line 7 permits periodic refilling of tank 1 from a LNG transport such as a truck or railroad car. Fill line 7 splits into a top fill line **7*a* and bottom fill line 7*b*. The top fill line 7*a* sprays a relatively small portion of the delivered LNG into the gas head 5 such that the gas head 5 condenses. As the gas condenses the pressure in vessel 1 decreases such that the main portion of LNG being delivered through bottom fill line 7*b* is facilitated. The LNG is preferably supplied to vessel 1** from the mobile supply at approximately 5–10 psi.

An insulated pressure building tank 9 is provided to pressurize the LNG to the desired pressure for delivery to vehicles such as buses, trucks, vans and other vehicles typically found in a fleet. A LNG delivery line 11 delivers LNG from the storage vessel 1 to the pressure building tank 9. Flow of LNG between tank 1 and tank 9 is controlled by valve 12. Delivery of LNG from vessel 1 to tank 9 can only occur if the pressure in tank 9 is less than the pressure in vessel 1. Thus, the pressure in tank 9 is reduced, if necessary, as described hereafter, to a pressure below that in vessel 1. Typically, the filling operation will occur at a time when no demand is being made on the system for delivery of LNG.

After tank 9 has been filled with LNG 13 a gas head 15 will be created. A plastic float 17 is provided between the LNG 13 and gas head 15. Float 17 separates the LNG 13 from the relatively warm gas head 15 to minimize the heat transfer therebetween and prevent the uncontrolled vaporization and/or condensation that would otherwise occur. Minimizing this heat transfer allows the system pressures to be more precisely controlled.

A pressure building line 23 is provided on tank 9 connecting the LNG 13 with the gas head 15. Pressure building line 23 is provided with an uninsulated coil 25 that maximizes the heat transfer between the LNG in line 23 and the ambient environment. As a result, the LNG is vaporized and is delivered to the head 15 as a gas thereby to increase the pressure in tank 9 when necessary A pressure sensor 27 is provided in pressure building line 23 to control valve 29 such that when the pressure of head 15 falls below a predetermined value, sensor 27 will open valve 29 to allow gas to flow through line 23 and rebuild the head pressure.

A pressure relief line 31 is provided between gas head 5 of vessel 1 and gas head 15 of tank 9. A pressure regulator 33 is provided in line 31 that allows gas to travel from head 5 to head 15 when the pressure of head 5 rises above the predetermined value set by regulator 33. Because the pressure in tank 9 can be controlled, as will hereinafter be described, the gas pressure from head 5 can be controlled as desired to insure trouble free delivery of LNG.

A main use line 41 is provided to deliver LNG from tank 9 to a vehicle via two-way injection valve 45. A low quantity use line 39 connects the LNG in tank 9 to the main use line 41 at three-way valve 43. Three-way valve 41 is, preferably, electronically operated and can connect the two-way injection valve 45 with either main use line 41 or low quantity use line 39. A scale 55 is provided on tank 9 to act as a meter to thereby regulate the amount of LNG delivered to the vehicle.

Main use line 41 is used whenever large quantities, i.e. 10 or more gallons, of LNG are to be delivered. Main use line 41 delivers the LNG directly from tank 9 to two-way injection valve 45 via valve 43.

Low quantity use line 39 is used to deliver small quantities, i.e. less than 10 gallons, of LNG to the vehicle. When small quantities of LNG are delivered, heat transfer to the LNG during its conveyance through the use line becomes problematic because some of the LNG will vaporize before reaching the vehicle. For small quantities of LNG, therefore, a heat exchanger 47 is provided to sub-cool the LNG. Thus, even though small quantities of LNG are delivered through line 39 the heat transfer to the LNG in line 39 does not present a vaporization problem because the LNG delivered therethrough is sub-cooled by liquid Nitrogen ($LN_2$) as will be described hereinafter.

A vent line 49 connects head 15 of tank 9 with two-way injection valve 45. Specifically, vent line 51 connects head 5 of tank 1 with line 49 at three-way valve 53. Vent line 51 can be selectively connected to two-way injection valve 45 by threeway valve 53 to vent high pressure gas from the vehicle's fuel tank back to head 5. Alternatively, line 49 can be selectively connected to injection valve 45 by valve 53 to vent high pressure gas from the vehicle's fuel tank to head 15, if so desired Venting the high pressure gas from the vehicle facilitates the delivery of LNG by lowering the pressure in the vehicle's fuel tank. Alternatively, if, after the filling operation, the pressure in the vehicle's fuel tank is too low, vent line 49 can be connected to two-way injection valve 45 to pressurize the vehicle's tank with high pressure gas from head 15.

A cooling tank 16 holds a supply of liquid nitrogen ($LN_2$) 20 having a gas head 18 formed therein as previously described with respect to head 5. While $LN_2$ is preferred any suitable condensing agent, such as liquid oxygen (LOX), may be used. Moreover, a mechanical refrigerator could also be used. The $LN_2$ is used as a heat transfer medium to control the pressure and temperature of the LNG in the system. In this regard, a first cooling line 57 is provided that passes through head 15 in tank 9. Cooling line 57 includes a vaporizer coil 59 located in head 15 that acts as a heat sink and maximizes the transfer of heat from head 15 to the $LN_2$ traveling through line 57. As the $LN_2$ passes through coil 59, heat is transferred to the $LN_2$ such that the head gas 15 is cooled and condenses. The $LN_2$ becomes warmer and eventually vaporizes. As the head gas condenses the pressure in tank 9 will decrease Thus by controlling the flow of $LN_2$ through coil 59 the pressure in tank 9 can be controlled. In this regard, a pressure sensor 61 detects the pressure of head 15 to open or close valve 63 in response to the pressure of head 15. If the pressure of head 15, as sensed by sensor 61, rises above a predetermined value, valve 63 is opened to allow $LN_2$ to flow through coil 59 and condense the head gas. When the pressure falls below the predetermined value, valve 63 is closed. Any $LN_2$ vaporized in coil 59 is returned to tank 16 via line 64 thereby increasing the pressure in tank 16.

Tank 16 is also provided with a second cooling loop 38 which carries $LN_2$ to and from heat exchanger reservoir 47. Reservoir 47 surrounds cooling coil 48 located in low quantity use line 39. As $LN_2$ is circulated through cooling loop 38 it will sub-cool any LNG being delivered through use line 39 to ensure that the LNG does not vaporize during fueling. Sub-cooled LNG is LNG cooled to a temperature below its equilibrium temperature for a given pressure.

Cooling tank 16 is provided with a vent line 19 having a pressure regulator 21 located therein. Because the heat transfer occurring at coils 48 and 59 will result in the development of nitrogen gas and a concomitant increase in pressure in tank 16, periodically it is necessary to vent the gas in tank 16. Regulator 21 is set such that when the pressure in the tank rises above a predetermined value, the regulator will allow the nitrogen gas to vent to the atmosphere. As is evident from the forgoing description, only harmless, environmentally safe nitrogen is vented to the atmosphere without loss of LNG due to venting.

Two-way injection valve 45 is shown in detail in FIG. 2 and 3. It consists of a tubular member 70 having main control valve 71 at one and thereof that can connect the injection valve to either line 49 or 41. The opposite end of member 70 includes a flange 73 carrying a seal 74 and a locking collar 75. Locking collar 75 includes screwthreads 76 that mateably engage screwthreads 77 found on the vehicle's fuel pipe 79 such that seal 75 forms a liquid-tight fit with the end of the fuel pipe 79.

Both tubular member 70 and fuel pipe 79 include spring held check valves 80 and 82, respectively, for preventing the flow of fluid between the vehicle's fuel tank and the fueling station of the invention. Activating lever 79 opens both check valves such that either LNG or natural gas can flow from tank 9 to the vehicle or natural gas can flow from the vehicle to the fueling station as determined by the position of main control valve 71, the position of three-way valves 43 and 53, and the relative pressures in the system. A plug 81 and cap 83 are provided to seal the injection nozzle 45 and fuel pipe 79, respectively, when the filling operation is completed.

In operation, LNG is delivered from storage tank 1 to pressure building tank 9 by opening valve 12. The LNG will travel from tank 1 to tank 9 only if the pressure in tank 9 is lower than the pressure in tank 1. Because the pressure in tank 1 is maintained at approximately 50 psi, it is necessary to lower the pressure in tank 9. Thus, valve 63 is opened to allow $LN_2$ to be conveyed through cooling line 57 and cooling coil 59 thereby to condense the gas in head 15 until the pressure in tank 9 falls below the pressure in tank 1.

Once tank 9 is filled with LNG, its pressure can be maintained at any desired level by using the pressure building line 23 to increase the pressure and the cooling line 57 to decrease the pressure sensors 27 and 61 located in pressure building line 23 and cooling line 57, respectively, automatically open and close valves 63 and 29 to thereby automatically maintain the pressure in tank 9 within a desired range.

When the pressurized LNG in tank 9 is to be delivered to the vehicle, two-way injector valve 45 is connected to the fuel line 79 of the vehicle by locking collar 75. If the pressure in the vehicle's fuel tank is too high, line 51 can be connected to valve 45 via three-way valve 53 to deliver the pressurized gas in the vehicle tank to tank 1. Alternatively, line 49 can be connected to tank 9 via line 49 by valve 53 to deliver the pressurized gas to tank 9. The orientation of valve 53 would depend on operation preference as to whether the pressure in tank 1 or tank 9 should be increased.

If a large quantity of LNG is desired, the delivery would be made through line 41. In that case, three-way valve 43 would connect line 43 to valve 45. If a small quantity of LNG was desired, three-way valve 43 would connect line 39 to valve 45 and cooling loop 38 would pass LN through heat exchanger 47 to sub-cool the LNG before it was delivered through line 39.

After the vehicle's fuel tank was filled with LNG, it may be necessary to rebuild the pressure therein. In this situation, three-way valve 53 would connect gas head 15 to injection valve 45. The high pressure gas in tank 9 would be delivered from gas head 15 to the vehicle's fuel tank upon the opening of valve 45.

Finally, if at any time the pressure in tank 1 should rise above the predetermined value set at regulator 33, line 31 would deliver this gas from head 5 to tank 9 where it would be stored or condensed by coil 15. Suitable electronic controls and sensors or gauges and manually operated valves can be used to operate the valves in response to the demands made on the system.

It is to be understood that the foregoing description and drawings are offered merely by way of example and that the invention is to be limited only as set forth in the appended claims.

What is claimed is:

1. A no loss fueling station for delivery of liquid natural gas (LNG) to a use device such as a motor vehicle, comprising:

a) a pressure building tank holding a quantity of LNG and a gas head;

b) means for delivering LNG to the pressure building tank;

c) means for selectively building the pressure in the pressure building tank;

d) means for selectively reducing the pressure in the pressure building tank;

e) means for controlling the pressure building and pressure reducing means to maintain a desired pressure in the pressure building tank without venting natural gas to the atmosphere; and f) means for delivering the LNG from the pressure building tank to the use device.

2. The fueling station according to claim 1, wherein said delivering means consists of a storage tank holding a quantity of LNG greater than that in said pressure building tank.

3. The fueling station according to claim 2, wherein said storage tank includes a gas head and further includes means for communicating the gas head in the pressure building tank with the gas head in said storage tank.

4. The fueling station according to claim 1, wherein the pressure building means includes means for vaporizing LNG in the pressure building tank thereby to increase the pressure therein.

5. The fueling station according to claim 1, wherein the means for reducing pressure includes means for condensing the natural gas head in the pressure building tank.

6. The fueling station according to claim 5, wherein said means for condensing includes a heat sink disposed in the gas head portion of said pressure building tank and means for passing relatively cooler fluid through said heat sink thereby to condense the gas head and reduce pressure.

7. The fueling station according to claim 1, further including means for selectively sub-cooling the LNG before delivering it to the use device.

8. The fueling station according to claim 1, further including means for filling said pressure building tank with LNG.

9. The fueling according to claim 1, further including means for delivering LNG and natural gas to the use device and for first delivering natural gas from the use device to the fueling station if necessary to create a pressure differential to permit refilling.

10. The fueling according to claim 9, wherein said delivering means includes an injector means having a single output port, a plurality of input ports and means for connecting the output port with one of the input ports.

11. The fueling according to claim 9, further including a first means for communicating the LNG in said pressure building tank to said injector means.

12. The fueling according to claim 9, further including a second means for communicating the gas head in said pressure building tank to said injector means.

13. The fueling station according to claim 1, wherein the use device is a motor vehicle.

14. A no lose fueling station for delivery of liquid natural gas (LNG) to a use device such as a motor vehicle, comprising:

a) a pressure building tank holding a quantity of LNG and a gas head;

b) means for selectively building the pressure in the pressure building tank;

c) means for selectively reducing the pressure in the pressure building tank;

d) means for controlling the pressure building and pressure reducing means to maintain a desired pressure in the pressure building tank without venting natural gas to the atmosphere; and e) means for delivering the LNG from the pressure building tank to the use device.

15. The fueling station according to claim 14, wherein the pressure building means includes means for vaporizing LNG in the pressure building tank thereby to increase the pressure therein.

16. The fueling station according to claim 14, wherein the pressure reducing means includes means for condensing the natural gas head in the pressure building tank.

17. The fueling station according to claim 16, wherein said means for condensing includes a heat sink disposed in the gas head portion of said pressure building tank and means for passing relatively cooler fluid through said heat sink thereby to condense the gas head and reduce pressure.

18. The fueling station according to claim 14, further including means for selectively sub-cooling the LNG before delivering it to the us device.

19. The fueling station according to claim 18, wherein the means for selectively sub-cooling includes a heat exchanger having relatively cooler fluid passing therethrough.

20. The fueling station according to claim 14, further including means for filling said pressure building tank with LNG.

21. The fueling according to claim 14, further including means for delivering LNG and natural gas to the use device and for first delivering natural gas from the use device to the fueling station if necessary to create a pressure differential to permit refilling.

22. The fueling according to claim 21, wherein said delivering means includes an injector means having a single output port, a plurality of input ports and means for connecting the output port with one of the input ports 23. The fueling according to claim 22, further including a first means for communicating the LNG in said pressure building tank to said injector means.

24. The fueling according to claim 22, further including a second means for communicating the gas head in said pressure building tank to said injector means.

25. The fueling station according to claim 14, wherein the use device is a motor vehicle.

* * * * *